United States Patent [19]

Kato et al.

[11] Patent Number: 4,715,054

[45] Date of Patent: Dec. 22, 1987

[54] PLASMA X-RAY SOURCE

[75] Inventors: Yasuo Kato, Zama; Kunio Harada, Hachioji; Shigeo Kubota, Kokubunji; Yoshio Watanabe, Tokyo; Seiichi Murayama, Kokubunji, all of Japan

[73] Assignee: Hitachi, Ltd., Tokyo, Japan

[21] Appl. No.: 795,776

[22] Filed: Nov. 7, 1985

[30] Foreign Application Priority Data

Nov. 9, 1984 [JP] Japan ..... 59-234925

[51] Int. Cl.[4] ..... H01J 35/00; H05G 1/00

[52] U.S. Cl. ..... 378/122; 378/136; 378/138; 315/111.21; 315/111.41; 313/231.41; 313/352

[58] Field of Search ..... 378/119, 140, 143, 203, 378/121, 122, 136, 34, 43; 315/111.21, 111.81; 313/231.41, 240, 231.21

[56] References Cited

U.S. PATENT DOCUMENTS 3,324,333 6/1967 Hahn ..... 313/231.41
4,540,868 9/1985 Liebing ..... 313/231.41
4,596,030 6/1986 Herziger et al. ..... 378/119

FOREIGN PATENT DOCUMENTS 0108249 6/1984 Japan ..... 378/119

OTHER PUBLICATIONS

J. Plasma Physics (1972), vol. 8, Part 1, pp. 7–20, "X-Ray Fine Structure of Dense Plasma in Coaxial Accelerator".

*Primary Examiner*—David K. Moore
*Assistant Examiner*—Mark R. Powell
*Attorney, Agent, or Firm*—Antonelli, Terry & Wands

[57] ABSTRACT

A plasma X-ray source comprises inner and outer cylindrical electrodes disposed coaxially and with a certain distance with respect to each other, an electrical insulator disposed between end portions of the inner and outer cylindrical electrodes, and a discharge vessel disposed to envelop the inner and outer cylindrical electrodes. A pulse voltage is applied between the inner and outer cylindrical electrodes to produce plasma in the discharge vessel. An electrically conductive spherical shield is disposed to envelop a space where the plasma is pinched, and the spherical shield is maintained at a potential equal to that applied to the outer cylindrical electrode.

6 Claims, 2 Drawing Figures

PLASMA X-RAY SOURCE

BACKGROUND OF THE INVENTION

This invention relates to a plasma X-ray source producing soft X-rays by forming a high temperature and high density plasma by means of pulse discharge in a discharge tube using coaxial electrodes, and in particular to a plasma X-ray source which is suitable for a source of an X-ray aligner for manufacturing submicron integrated circuits.

The plasma focus is well known as a representative example of discharge tubes having coaxial electrodes. Research has been conducted heretofore on the plasma focus as sources generating neutrons, for which gas such as heavy hydrogen filled in a discharge tube having coaxially disposed cylindrical electrodes is turned into plasma by applying a pulse voltage from a capacitor to the electrodes and the plasma is accelerated in the space defined between the electrodes so as to be focussed in the neighborhood of the extremity of one of the electrodes so that a high temperature and high density plasma is formed. However, since strong soft X-rays are also emitted from a high temperature and high density plasma produced by the plasma focus, recently attention is paid thereto also as an X-ray source.

Since the construction and the working mode of the plasma focus are simple and the brightness of the source is high, the plasma focus has a possibility to be an excellent X-ray source, but it has a problem that the position of the spot emitting soft X-rays moves from shot to shot. Although it is expected that the spot of the plasma focus is formed on the axis of the coaxial electrodes, in practice it is deviated often from the axis, and even if it is formed on the axis, its position varies thereon. This aspect is described e.g. in W. H. Bostick, V. Nardi and W. Prior: "X-ray fine structure of dense plasma in a coaxial accelerator", J. Plasma Physics, Vol. 8, pt 1, pp. 7–20 (1972).

For a reason why such variations are produced, heretofore, instability of plasma itself has been known, but other reasons therefor have not been clarified.

SUMMARY OF THE INVENTION

An object of this invention is to provide a plasma X-ray source using coaxial electrodes, e.g. an X-ray source using a plasma focus, in which variations in position of the X-ray source are reduced, the spot emitting X-ray is small, and the axial symmetricity of the source and the brightness of the X-ray source is increased.

In order to achieve this object, according to this invention, turbulence and distortion of electric and magnetic fields are removed, which disturb and prevent pinching of the plasma in the space beyond the open end of the coaxial electrodes. For this purpose, it is proposed to dispose a shield made of a material having a high electric conductivity and formed so that its inner surface is spherical or almost spherical, which envelops the space including the extremity of the coaxial electrodes and whose potential is maintained at a value equal or close to that of the outer cylindrical electrode.

That is, this invention is based on the knowledge that one of the reasons why variations in position and brightness of the source are provoked in a plasma X-ray source is that turbulance and distortion of electric and magnetic fields in the space where the plasma is pinched give rise thereto.

DESCRIPTION OF THE PREFERRED EMBODIMENTS

This invention will now be explained, using some preferred embodiments.

Figure 1:
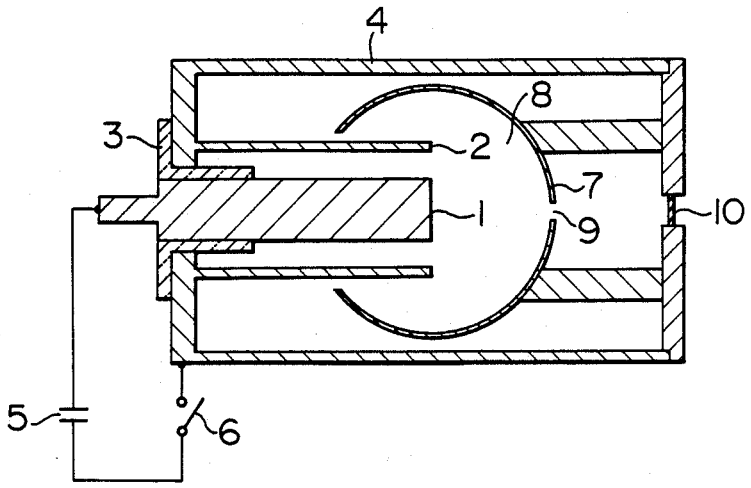
FIG. 1 is a cross-sectional view showing the construction of an embodiment of a plasma focus discharge tube according to this invention.

FIG. 1 is a cross-sectional view showing the construction of a plasma focus discharge tube according to an embodiment of this invention. In this discharge tube are disposed coaxially an inner cylindrical electrode 1 as an anode and an outer cylindrical electrode 2 as a cathode. These two electrodes are isolated from each other by means of an insulator 3 made of glass. These are located in a discharge vessel 4 which is filled with gas such as neon, argon, krypton, xenon, etc. at a pressure of 0.1–1 Torr.

To these electrodes 1, 2 is connected a charged capaciter 5 through a spark gap switch 6. When this spark gap switch 6 is closed, a high voltage pulse is applied between the electrodes 1 and 2, thereby giving rise to breakdown along the surface of the glass insulator 3 and generation of plasma. The plasma is forced to move along the electrode 1 by electric and magnetic fields between the electrodes 1, 2. When it exceeds the extremity of the electrode 1, it is focused by the pressure of the magnetic field and forms a hot spot of plasma at the neighborhood of the axis of the extremity of the inner cylindrical electrode 1, thereby emitting a soft X-ray.

In this embodiment, a shield 7 made of a metal sphere is so disposed that the center of the sphere is on the axis of the extremity of the inner cylindrical electrode 1 and that the sphere envelops a part of the coaxial electrodes 1, 2. The shield 7 which is maintained at a potential, which is equal to that of the outer cylindrical electrode 2, makes the distribution of the electric field close to a symmetricity and prevents a varying magnetic field from penetrating from the outside thereinto. In this way, it removes turbulence of electric and magnetic fields and helps symmetrical pinching of the plasma. In FIG. 1, reference numeral 9 indicates an aperture formed in the shield 7 for taking out an X-ray, and numeral 10 a window made of beryllium for taking out the X-ray.

The dimensions of the discharge tube used in this embodiment are as follows: outer diameter of the inner cylindrical electrode 25 mm; inner diameter of the outer cylindrical electrode 60 mm, length of the latter 150 mm; and diameter of the shield 150 mm.

Figure 2:
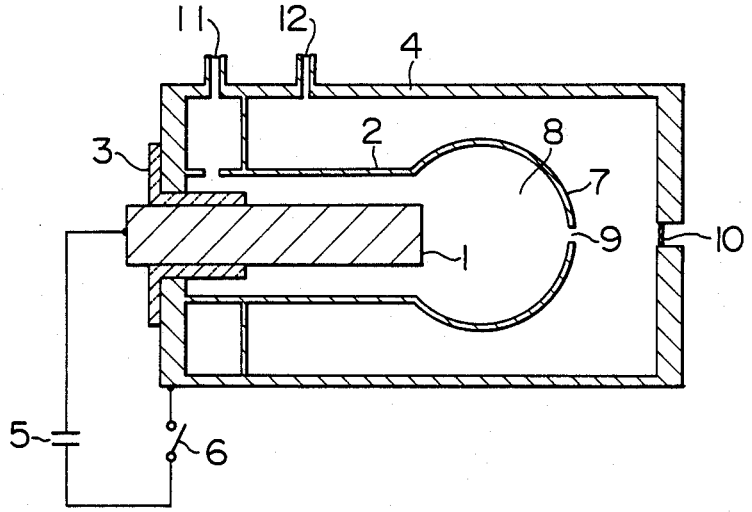
FIG. 2 is a cross-sectional view showing the construction of another embodiment of a plasma focus discharge tube according to this invention.

FIG. 2 is a cross-sectional view showing the construction of a plasma focus discharge tube according to another embodiment of this invention.

In this embodiment, the extremity of the outer cylindrical electrode 2 is connected with the spherical shield 7 having the center on the X-ray generating point on the axis and covers the space 8 where the plasma is focused. According to the construction of this embodiment, electric current flowing along the inner surface of the spherical shield 7 exerts a force on the plasma existing in the interior which force keeps the plasma away from the inner surface of the spherical shield 7 and directs the portion having a highest density of plasma toward the center of the spherical shield 7. This force can reduce displacements of the spot emitting X-ray from the axis and at the same time limit the position of the spot in a region near the center of the spherical shield 7. It is known by calculations that the strength of the restoring force directing the plasma deviated from the axis again toward the axis is proportional to the magnitude of the deviation from the axis and inversely proportional to the cube of the radius of the spherical shield 7. On the basis of this result, it is possible to reduce the deviation of the spot of plasma from the axis and its fluctuations on the axis by reducing the radius of the spherical shield 7. According to this invention, it is possible to restrict the position of the spot emitting X-ray, whose fluctuations were hitherto considerable, in a region near the center of the spherical shield 7. In FIG. 2, reference numerals 11 and 12 represent an inlet and an outlet, respectively, formed in the discharge vessel 4.

As described above, according to this invention, in a plasma X-ray source having coaxial electrodes, it is possible to form a spot of high temperature and high density plasma on the axis, to reduce fluctuations of the position of the X-ray source, to increase its symmetricity, to reduce the diameter of the source and thus increase brightness and to ameliorate shot-to-shot reproducibility by using a spherical or almost spherical shield made of an electrically well conductive substance and maintained at a potential equal to that of the outer cylindrical electrode, which shield covers a part of the coaxial electrodes and the space where the plasma is pinched, so as to make the distribution of the electric field in the space where the plasma is pinched to be symmetric, to remove turbulence of the magnetic field, and to allow an axial symmetric pinch of the plasma.

Furthermore, by the realization of this invention, many modifications such as formation of the discharge tube itself in a spherical shape may be possible without departing from the spirit of this invention.

In addition, although this invention has been described in conjunction with the embodiments limited to the plasma focus, it is, of course, not restricted to chose embodiments, and it is possible to obtain similar effects by realizing plasma X-ray sources utilizing pinch effect such as gas puff Z-pinch, vacuum spark, etc.

We claim:

1. A plasma X-ray source comprising:

an inner cylindrical electrode;

an outer cylindrical electrode disposed coaxially and with a predetermined distance with respect to said inner cylindrical electrode;

an electrically insulating means disposed between an extremity of said inner cylindrical electrode and that of said outer cylindrical electrode corresponding thereto;

a discharge vessel disposed to envelop said inner and outer cylindrical electrodes;

means for applying a pulse voltage between said inner and outer cylindrical electrodes to produce plasma in said discharge vessel; and an electrically conductive spherical shield disposed to envelop a space where said plasma is pinched, said electrically conductive spherical shield being maintained at a potential equal to that applied to said outer cylindrical electrode.

2. A plasma X-ray source according to claim 1, wherein said electrically conductive spherical shield is connected to the other extremity of said outer cylindrical electrode.

3. A plasma X-ray source according to claim 1, wherein said electrically conductive spherical shield is disposed within said discharge vessel and stabilizes a location of a plasma spot for generating X-rays at a position proximate to the center of said spherical shield.

4. A plasma X-ray source comprising:

an inner cylindrical electrode;

an outer cylindrical electrode disposed coaxially and with a predetermined distance with respect to said inner cylindrical electrode;

electrical insulating means disposed between an extremity of said inner cylindrical electrode and an extremity of said outer cylindricl electrode corresponding thereto;

a discharge vessel disposed to envelope said inner and outer cylindrical electrodes;

means for applying a pulse voltage between said inner and outer cylindrical electrodes to produce plasma in said discharge vessel; and means for preventing turbulence and distortion of electric and magnetic fields in a space from said discharge vessel where said plasma is pinched, said turbulence and distortion preventing means including an electrically conductive spherical shield disposed to envelope the space where said plasma in pinched for providing a stabilization of a location of a plasma spot for generating X-rays, said electrically conductive spherical shield being maintained at a potential equal to a potential applied to said outer cylindrical electrode.

5. A plasma X-ray source according to claim 4, wherein said electrically conductive spherical shield is connected to the outer extremity of said outer cylindrical electrode.

6. A plasma X-ray source according to claim 4, wherein said spherical shield stabilizes the location of the plasma spot at a position proximate to the center of said spherical shield.

* * * * *